US005872554A

United States Patent [19]

Chang et al.

[11] Patent Number: 5,872,554

[45] Date of Patent: Feb. 16, 1999

[54] METHOD AND APPARATUS FOR NON-BLINKING DISPLAYING OF GRAYSCALE IMAGE ON MONOCHROME LCD SCREEN

[75] Inventors: Ching-Sung Chang; Dai-Shui Ho; Jihong Shen; Chase Yu, all of Taipei, Taiwan

[73] Assignee: Inventec Corporation, Taipei, Taiwan

[21] Appl. No.: 543,407

[22] Filed: Oct. 16, 1995

[51] Int. Cl.[6] ..... G09G 5/10

[52] U.S. Cl. ..... 345/147; 149/89

[58] Field of Search ..... 345/147, 148, 345/149, 87, 89

[56] References Cited

U.S. PATENT DOCUMENTS

| | | | |
|---|---|---|---|
| 5,122,783 | 6/1992 | Bassetti, Jr. | 345/88 |
| 5,185,602 | 2/1993 | Bassetti, Jr. et al. | 345/89 |
| 5,313,224 | 5/1994 | Singhal et al. | 345/99 |

*Primary Examiner*—Matthew Luu
*Attorney, Agent, or Firm*—Morland C. Fischer

[57] ABSTRACT

Disclosed is a method and apparatus for displaying (simulating) grayscale images on a monochrome LCD screen particularly with an objective of providing a comfortable displaying effect that presents no blinking of dots to the user's eyes. In the method, the grayscale image is divided into a sequence of pages of image data each having an array of dots equal to the resolution of the grayscale image such that each pixel on the grayscale image corresponds to a sequence of dots respectively on the corresponding location on the N−1 pages of image data. Black and white colors are assigned to the dots in accordance with a color assignment algorithm that allows the black and white colors to be evenly distributed. When the pages are displayed in succession at a fast rate on the monochrome screen to simulate grayscale image, the black dots or white dots appear evenly on each page so that blinking of dots would not present to the user's eyes.

4 Claims, 6 Drawing Sheets

4 Level Grayscale

4-Level Grayscale

4 Level Grayscale

METHOD AND APPARATUS FOR NON-BLINKING DISPLAYING OF GRAYSCALE IMAGE ON MONOCHROME LCD SCREEN

BACKGROUND OF THE INVENTION

1. Field of the Invention

The present invention relates to method and apparatus for displaying grayscale images, and more particularly, to a method and apparatus for displaying grayscale images on a monochrome LCD screen.

2. Description of Prior Art

LCD (liquid crystal display) is nowadays in the information age widely used on small-scale data processing units which can be handheld or portable as PDAs (Personal Digital Assistant), notebook computers, subnotebook computers, electronic dictionaries, and the like. A monochrome LCD screen is composed of an array of tiny LCD cells, each capable of displaying only two colors: white and black. Presently, small-scale data processing units are primarily used for word processing purposes so that the LCD only needs to display text or icons. A monochrome screen is thus adequate to support most of the applications on a small-scale data processing unit.

However, with the coming of the multimedia applications, there are demands for the small-scale data processing units to display images. Responding to such demands, there are offered grayscale and color displays. These displays can show grayscale or color images in high resolution but, however, are often expensive to implement. Moreover, these displays often require customized drivers so that cost is high.

On PDAs and electronic dictionaries, a cost-effective method for displaying (simulating) grayscale images on a monochrome screen is to divide a grayscale image into multiple pages of "black and white" images and then display these pages in a predetermined sequence cyclically at a very high rate on the screen. One example of such a method is depicted in FIG. 1. In the example shown, the monochrome LCD screen is used to simulate a 4-level grayscale display. The four gray levels are as listed below:

| Gray Level | Color |
|---|---|
| 0 | Black |
| 1 | Dark Gray |
| 2 | Light Gray |
| 3 | White |

Using the method, an original grayscale image is divided into three pages. If a pixel on the original image has a gray level of 0 (black), the corresponding dots on the three pages are all black; if gray level 1 (dark gray), the corresponding dots on thee first page and the second page are black and that on the third page is white; if gray level 2 (light gray), the corresponding dot on the first page is black and that on the second page and third page are white; and if gray level 3 (white), the corresponding dots on all the three pages are white.

To simulate the grayscale color of a pixel, the three pages are displayed cyclically at a very fast rate in a predetermined sequence from Page 1 through Page 3. In hardware implementation, an LCD cell displays white when a voltage $V_{rm0}$ is applied thereto, and displays black when a voltage $V_{rm3}$ is applied thereto. Accordingly, to make an LCD cell simulate a gray level 0 color (black), the voltage sequence ($V_{rm3}$, $V_{rm3}$, $V_{rm3}$) is applied cyclically to the LCD cell; to simulate a gray level 1 color (light gray), the voltage sequence ($V_{rm3}$, $V_{rm0}$, $V_{rm0}$) is applied; to simulate a gray level 2 color (dark gray), the voltage sequence ($V_{rm3}$, $V_{rm3}$, $V_{rm0}$) is applied; and to simulate a gray level 3 color (white), the voltage sequence ($V_{rm0}$, $V_{rm0}$, $V_{rm0}$) is applied.

The aforementioned method, however, has a drawback in that blinking of the simulated grayscale image is obvious to the user's eyes. The persistence of vision in the human eye cause the user to perceive the change of dots from black to white or from white to black when the frequency of such a change is low. It can be seen from FIG. 1 that in the aforementioned method the spatial frequency of the layout of the dots is low, allowing the user's eyes to perceive the changes of dots between black and white.

Besides, the period of the voltage sequence applied is too long, so that the frequency of change is low. Assume that the period required to display one page is T, since a total of (N−1) pages are required to simulate an N-level grayscale image, the time needed to display a complete cycle of all the (N−1) pages (call refresh time) is (N−1) * T The rate of tonal change in the simulated grayscale image is thus:

$$F_{tl}=1/[(N-1)*T]$$

where f=1/T.

The refresh frequency must be high enough to eliminate the blinking effect of the simulated grayscale image to the user's eyes.

SUMMARY OF THE INVENTION

It is therefore a primary objective of the present invention to provide a method and apparatus for displaying (simulating) grayscale images on a monochrome LCD screen without presenting blinking effect to the user's eyes.

In accordance with the foregoing and other objectives of the present invention, there is provided with a novel method and apparatus for simulating grayscale images on a monochrome LCD screen. The method for simulating an N-level grayscale image on a monochrome LCD screen comprises three steps. In Step 1, the grayscale image is divided into a sequence of N−1 pages of image data each having an array of dots equal to the resolution of the grayscale image such that each pixel on the grayscale image corresponds to a sequence of N−1 dots respectively on the corresponding location on the N−1 pages of image data; in Step 2, the sequence of N−1 dots are assigned with black and white colors based on the location of the corresponding pixel in accordance with a color assignment algorithm such that black dots are evenly distributed on each of the N−1 pages of image data; and in the final Step 3, the N−1 pages of image data are displayed sequentially and cyclically at a predetermined rate on the LCD screen. More specifically, the color assignment algorithm assigns the sequence of (N−1) dots corresponding to a pixel located at (X,Y) and displaying a grayscale color of level m in accordance with the following rule:

if Mod [(X−Y)/N]=k, k=0, 1 . . . N−1, the (k+1)th, (k+2)th . . . and (k+m)th pages are assigned with "black", where mod [[(X−Y)/N ] is the quotient of (X−Y) divided by N.

The apparatus for implementing the foregoing method, similar to conventional ones, includes a CPU, ROM and RAM modules, and means for controlling the displaying of image data on the monochrome LCD screen. The ROM module, however, stores a novel image processing program including a route implementing the aforementioned color assignment algorithm to obtain the (N−1) pages of image data. These (N−1) pages of image data are then stored in succession in a RAM module. When called to display on the LCD screen, the (N−1) pages of image data are sent one by one to a SRAM module and then, by means of DMA controller and LCD row and column drivers, displayed one by one at a fast rate of on the LCD screen.

BRIEF DESCRIPTION OF DRAWINGS

The present invention can be more fully understood by reading the subsequent detailed description of the preferred embodiments thereof with references made to the accompanying drawings, wherein.

DETAILED DESCRIPTION OF PREFERRED EMBODIMENT

The Method

Figure 1:
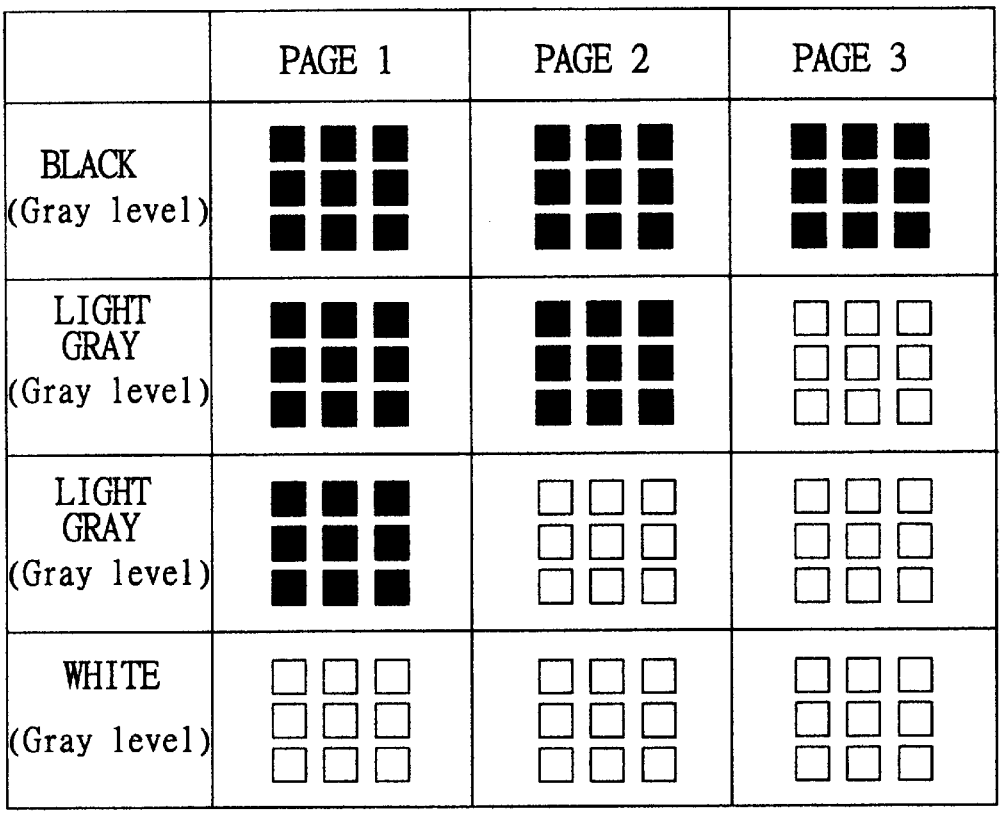
FIG. 1 shows the assignment of black and white colors by a prior art method to three pages of image data used to simulate a 4-level grayscale image.

In accordance with the present invention, the simulation of a grayscale color on a monochrome screen is based essentially on a novel color assignment algorithm. A general rule for the color assignment page division algorithm is that for an N-level grayscale image, N−1 pages (i.e, frames of the image) are required for the simulation, and for a gray level j pixel (black is gray level 0 and white is gray level N−1), there are j pages assigned with the color "white" and the rest (N−1−j) pages are assigned with the color "black".

For a pixel at the location (X,Y) on an (N+1)-level grayscale image, where X and Y represent the coordinates of a particular dot in a plane of the original grayscale image and N represent the level of the grayscale image, the corresponding dots on the N pages are to be assigned "black" or "white" according to the following rule (where Mod refers to the remainder after performing a division operation):

Gray level 0: all pages are assigned with "white".

Gray level 1: only 1 page is assigned with "black" and the other ones are "white". Which one page is assigned with "black" is determined according to the following: if Mod [(X−Y)/N]=k, k=0, 1 . . . N−1, the (k+1)th page is assigned with "black".

Gray level 2: only 2 pages are assigned with "black" and the other ones are "white". Which two pages are assigned with "black" is determined according to the following: if Mod [(X−Y)/N]=k, k=0, 1 . . . N−1, the (k+1)th and the (k+2) page are assigned with "black".

Gray level m: only m pages are assigned with "black" and the other ones are "white". Which m pages are assigned with "black" is determined according to the following: if Mod [(X−Y)/N]=k, k=0, 1 . . . N−1, the (k+1)th, (k+2)th . . . and (k+N−1)th pages are assigned with "black".

Gray level N−1: only (N−1) pages are assigned with "black" and the other ones are "white". Which (N−1) pages are assigned with "black" is determined according to the following: if Mod [(X−Y)/N]=k, k=0, 1 . . . N−1, the (k+1)th, (k+2)th . . . and (k+N−1)th pages are assigned with "black".

Gray level N: all Npages are assigned with "black".

Taking 4-level grayscale image as an example, N=3 in this case so that the image is divided into 3 pages. Assume that the resolution of the image is 3×3, then for all the pixels (X,Y), X=0,1,2 and Y=0,1,2, the corresponding dots on the three pages are assigned with "black" or "white" as follows:

Gray level 0: for all pixels, all pages are assigned with "black".

Gray level 1: only 2 page is assigned with "black" and the other one is "white".

For pixel (0,0), (P1, P2, P3)=(W, B, B);
For pixel (0,1), (P1, P2, P3)=(B, W, B);
For pixel (0,2), (P1, P2, P3)=(B, B, W);
For pixel (1,0), (P1, P2, P3)=(B, B, W);
For pixel (1,1), (P1, P2, P3)=(W, B, B);
For pixel (1,2), (P1, P2, P3)=(B, W, B);
For pixel (2,0), (P1, P2, P3)=(B, W, B);
For pixel (2,1), (P1, P2, P3)=(B, B, W);
For pixel (2,2), (P1, P2, P3)=(W, B, B);

Gray level 2: only 1 page is assigned with "black" and the other two pages are "white".

For pixel (0,0), (P1, P2, P3)=(H, W, W);
For pixel (0,1), (P1, P2, P3)=(W, B, W);
For pixel (0,2). (P1, P2, P3)=(W, W. B);
For pixel (1,0), (P1, P2, P3)=(W, W, B);
For pixel (1,1), (P1, P2, P3)=(B, W, W);
For pixel (1,2), (P1, P2, P3)=(W, B. W);
For pixel (2,0), (P1, P2, P3)=(W, B, W);
For pixel (2,1), (P1, P2, P3)=(W, W, B);
For pixel (2,2), (P1, P2, P3)=(B, W, W);

Gray level 3: for all pixels, all pages are assigned with "white".

Figure 2:
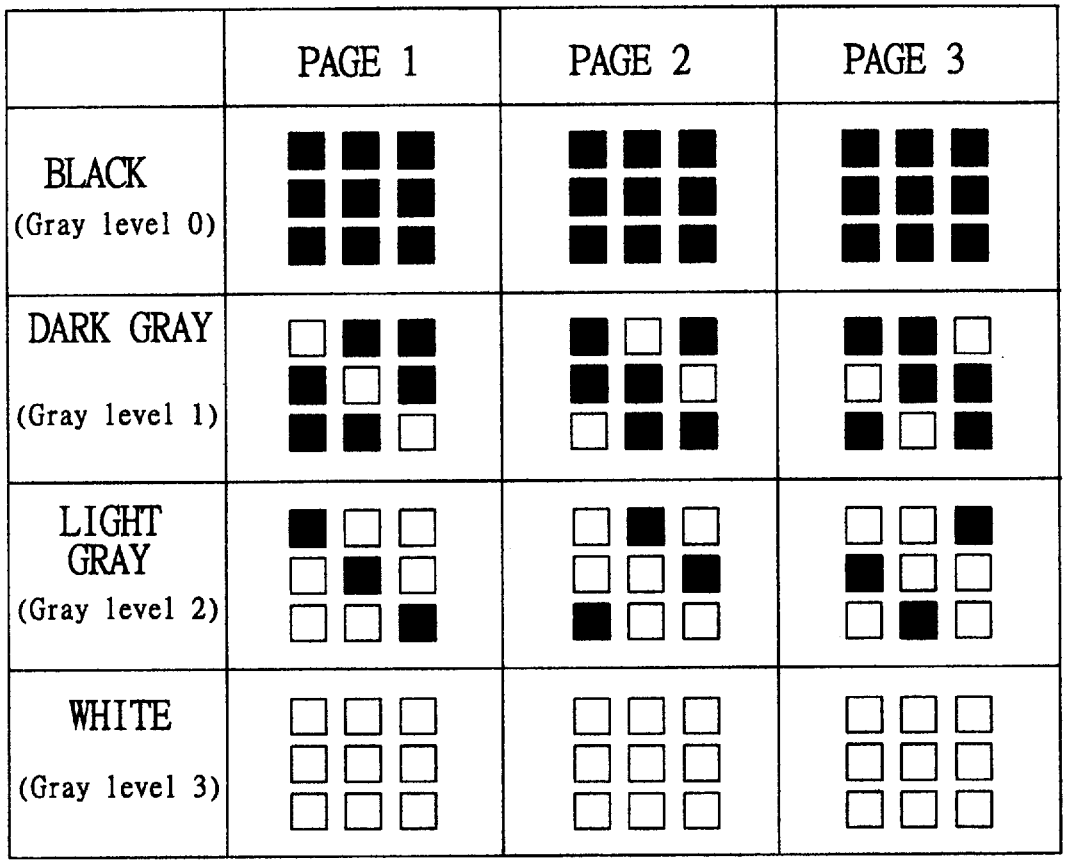
FIG. 2 shows the assignment of black and white colors by a method according to the present invention to three pages of image data used to simulate a 4-level grayscale image.

The foregoing result can be visualized as illustrated in FIG. 2. Comparing FIG. 2 with FIG. 1, it can be clearly seen that in the prior art method, all the black dots corresponding to a gray level 1 pixel appear only once in each cycle, while in the method according to the present invention, although for each individual dot, the black color appears also only once in each cycle, but viewing the image as a whole, black dots appear all the time. Since the black dots are evenly distributed on all pages, the user's eyes would perceive them at the appearance of each page. By means of the method according to the present invention, the user's eyes would perceive an evenly distributed pattern of black dots at the appearance of each page instead of perceiving one page filled completely with black dots and then the next page filled completely with white dots. Effectively, this allows the spatial frequency to be increased (N−1) times that of the prior art. Therefore, the rate of tonal change in the simulated grayscale image can be stated as follows:

$$\begin{aligned} F_{t2} &= F_{t1} * (N-1) = \{1/[(N-1) * T]\} * (N-1) \\ &= 1/T \\ &= f \end{aligned}$$

where $F_{t1}$ is the rate of tonal change in the simulated grayscale image by the prior art. Since $F_{t2}$ is increased essentially (N−1) times more than the prior art, the user's eyes would perceive a less degree of blinking of the dots. The simulated grayscale images can thus be more comfortably viewed by the user.

The Apparatus

Figure 3:
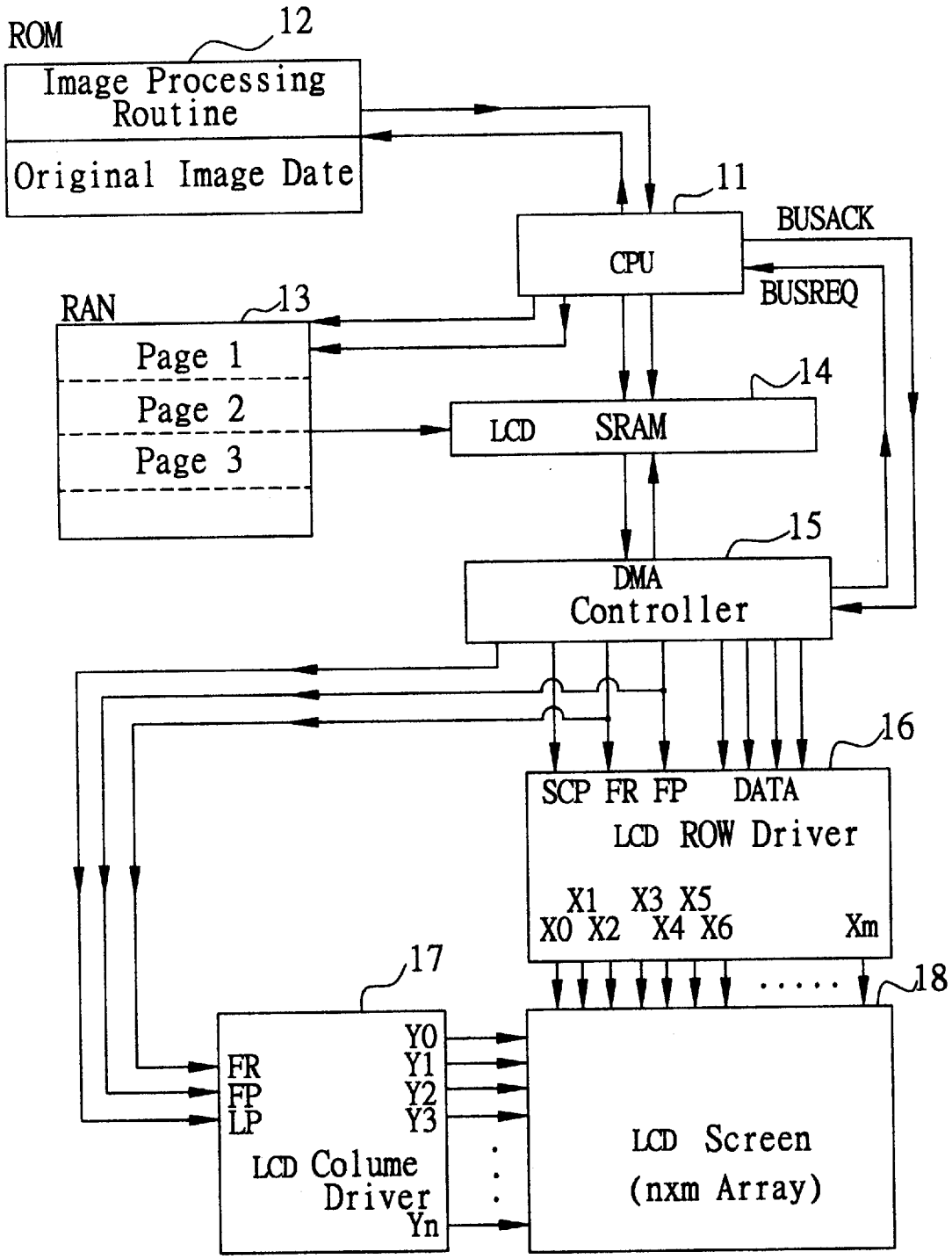
FIG. 3 shows a circuit diagram of an apparatus implementing the method according to the present invention.
Figure 4:
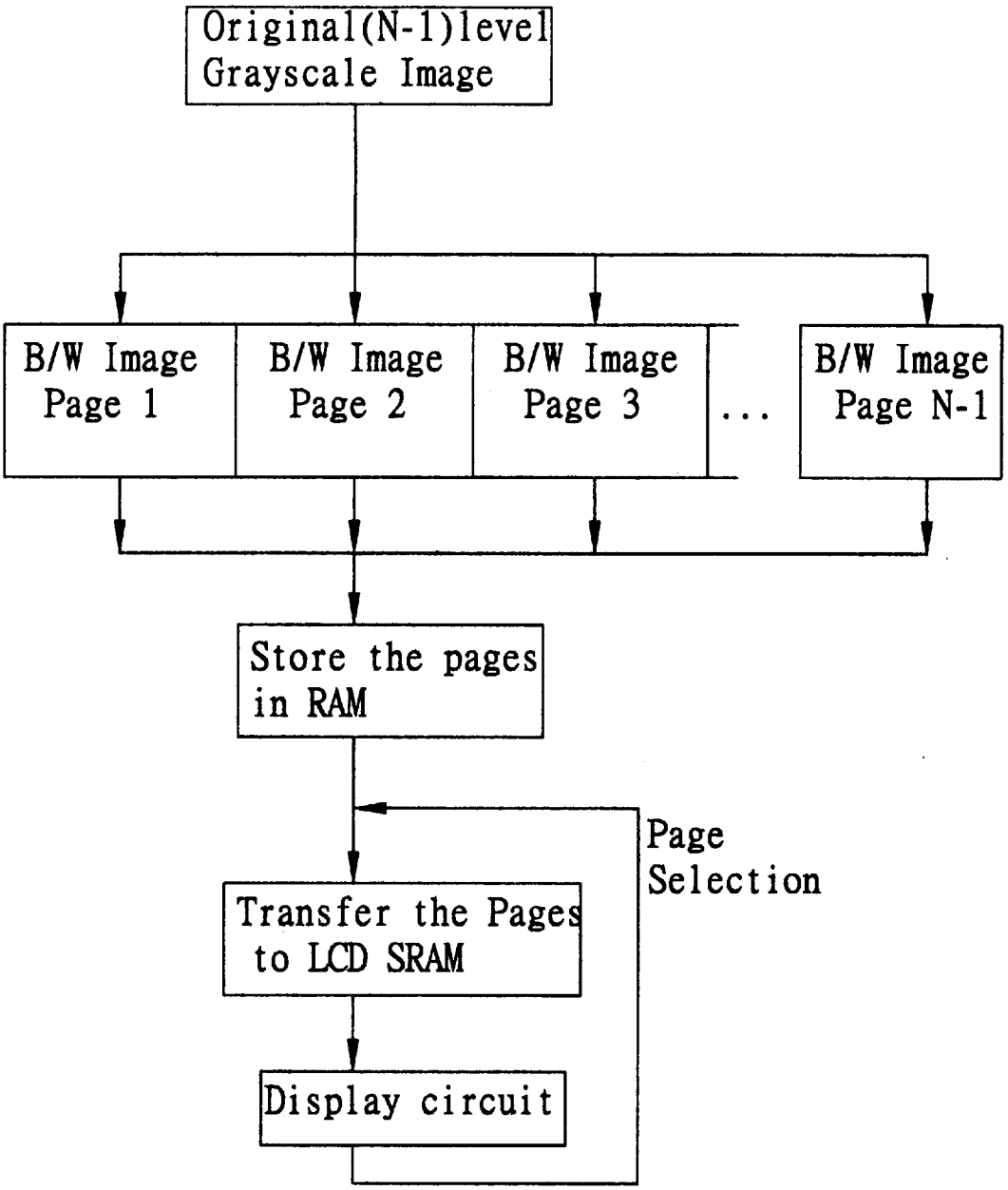
FIG. 4 shows a flow diagram of the procedure executed by the apparatus of FIG. 3 to simulate a grayscale image on a monochrome LCD screen.

Referring to FIG. 3, there is shown the circuit diagram of an apparatus that implements the method according to the present invention for displaying grayscale images on a monochrome LCD screen 18. The apparatus includes a CPU 11, a ROM module 12 for storing a page division program based on the algorithm described above, a RAM module 13 for storing page data, a SRAM module for temporarily storing the page data that is to be displayed on the LCD screen 18, a DMA controller 15 for controlling the flow of page data to an LCD row driver 16 and an LCD column driver 17 that are used respectively to drive the rows and columns of LCD cells on the LCD screen 18. A flow diagram of the procedure performed by the CPU 11 is illustrated in FIG. 4.

The original grayscale image is stored in the ROM module 12 and the CPU 11 executes an image processing program that includes a routine that implements the aforementioned color assignment algorithm to obtain a sequence of (N−1) pages of image data. These (N−1) pages of image data are then stored in succession in the RAM module 13. When called to display on the LCD screen 18, the DMA controller 15 issues a request via the BUSREQ bus to the CPU 11, asking the CPU 11 to fetch the (N−1) pages of image data from the RAM module 13 and send them one by one to the SRAM module 14. After that, the DMA controller 15 transfers each page from the SRAM module 14 to the LCD row and column drivers 16 and 17 so as to display the pages one by one at a rate of F, on the LCD screen 18.

Figure 5:
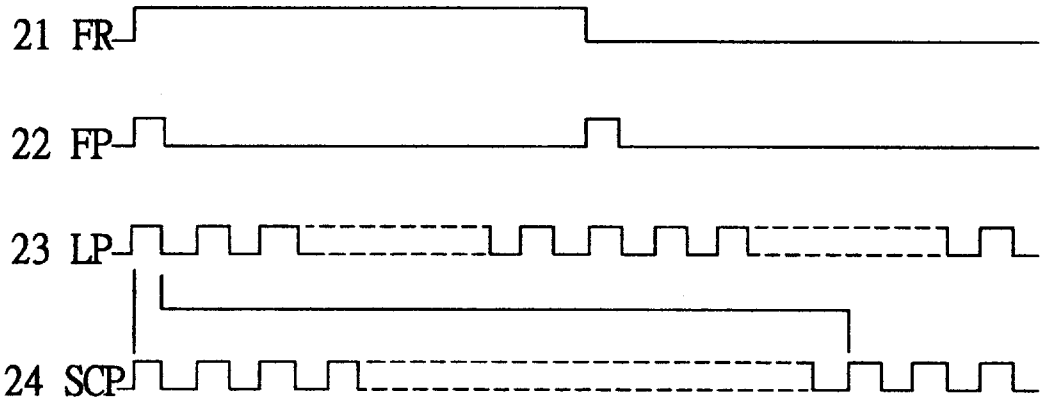
FIG. 5 shows waveform diagrams of four signals used by the apparatus of FIG. 3 to control the displaying of each page of image data on the monochrome LCD screen.

The waveforms of the signals FR, FP, LP, and SCP are shown in FIG. 5. The FR and FP signals are used for screen display synchronization, the LP signal for row synchronization that generates a pulse at the start of the scanning of each row, and the SCP signal for shift clock synchronization that provides a series pulses for the synchronization of the display of each page.

Figure 6:
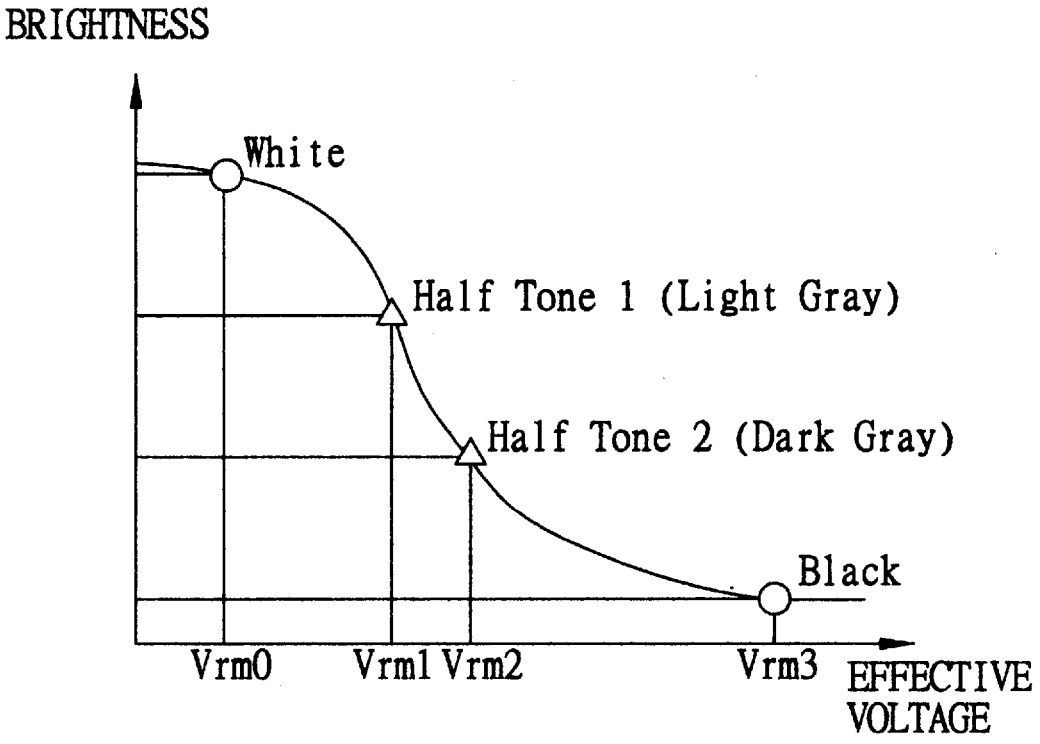
FIG. 6 is a graph showing the relationship between brightness (grayscale level) of an LCD cell and the effective voltage applied on that LCD cell.

Taking again N=4 as an example, to simulate gray level 0 color (black) on an LCD cell, the voltage sequence ($V_{rm3}$, $V_{rm3,\ vrm3}$) is applied in succession at a rate of $F_{12}$ to that LCD cell; to simulate gray level 1 color (dark gray), the voltage sequence ($V_{rm3}$, $V_{rm3,\ Vrm0}$) is applied; to simulate gray level 2 color (light gray), the voltage sequence ($V_{rm3}$, $V_{rm0,\ Vrm0}$) is applied; and to simulate gray level 3 color (black), the voltage sequence ($V_{rm0}$, $V_{rm0,\ Vrm0}$) is applied. As shown in FIG. 6, the average voltage (called effective voltage) used to simulate gray level 2 color is therefore $V_{rm1}$; and that used to simulate gray level 1 color is $V_{rm2}$.

The present invention has been described hitherto with exemplary preferred embodiments. However, it is to be understood that the scope of the present invention need not be limited to the disclosed preferred embodiments. On the contrary, it is intended to cover various modifications and similar arrangements within the scope defined in the following appended claims. The scope of the claims should be accorded the broadest interpretation so as to encompass all such modifications and similar arrangements.

What is claimed is:

1. A method for simulating a grayscale image of level N on a monochrome LCD screen, said method comprising the steps of:

(a) dividing the grayscale image into a sequence of N−1 pages of image data each having an array of dots equal to the resolution of the grayscale image such that each pixel on the grayscale image corresponds to a sequence of N−1 dots respectively on the corresponding location on the N−1 pages of image data;

(b) assigning the sequence of N−1 dots with black and white colors based on the location of the corresponding pixel such that black dots are evenly distributed on each of the N−1 pages of image data; and (c) displaying the N−1 pages of image data sequentially and cyclically at a predetermined rate on the LCD screen at a gray level of m, wherein the sequence of N−1 dots corresponding to a pixel located at coordinates X,Y is assigned according to the following color assignment relationship:

if Mod (X−Y)/N=k, k=0, 1 . . . N−1, the (k+1)th, (k+2)th . . . and (k+m)th pages are assigned with the color black and the other pages with the color white, where Mod (X−Y/N) is the remainder of (X−Y) divided by N.

2. An apparatus for simulating a grayscale image of level N on a monochrome LCD system, said apparatus comprising:

(a) means for dividing the grayscale image into a sequence of N−1 pages of image data each having an array of dots equal to the resolution of the grayscale image such that each pixel on the grayscale image corresponds to a sequence of N−1 dots respectively on the corresponding location on the N−1 pages of image data;

(b) means for assigning the sequence of N−1 dots with black and white colors based on the location of the corresponding pixel such that black dots are evenly distributed on each of the N−1 pages of image data; and (c) means for displaying the N−1 pages of image data sequentially and cyclically at a predetermined rate on the LCD screen at a gray level of m, wherein the sequence of N−1 dots corresponding to a pixel located at coordinates X,Y is assigned according to the following color assignment relationship;

if Mod (X,Y)/N=k, k=0,1 . . . N−1, the (k+1)th, (k+2)th . . . and (k+m)th pages are assigned with the color black and the other pages with the color white, where Mod (X−Y/N) is the remainder of (X−Y) divided by N.

3. An apparatus as claimed in claim 2, herein said assignment means includes a ROM module to store a program that executes the color assignment relationship.

4. An apparatus as claimed in claim 2, wherein said assignment means includes a RAM module to store the (N−1) pages of image data obtained from execution of the color assignment relationship.

* * * * *